United States Patent [19]

Swincicki

[11] Patent Number: 4,561,554

[45] Date of Patent: Dec. 31, 1985

[54] CONTAINER FOR PRODUCE, FRUITS GROCERIES AND THE LIKE

[76] Inventor: Edmund J. Swincicki, 1340 N. Congress Lot 33; Sunshine Lake Estate, Newport, Richey, Fla. 33552

[21] Appl. No.: 570,689

[22] Filed: Jan. 13, 1984

Related U.S. Application Data

[63] Continuation-in-part of Ser. No. 305,737, Sep. 25, 1981, abandoned.

[51] Int. Cl.[4] ..... B65D 6/16; B65D 21/02; B65D 43/12

[52] U.S. Cl. ..... 220/4 F; 206/508; 206/509; 206/403; 217/12 R; 217/52; 217/62; 220/231; 220/327; 220/345; 220/346; 220/94 A

[58] Field of Search ..... 206/508, 509, 403, 404; 220/4 F, 327, 231, 345, 346, 94 A; 217/12 R, 52, 62

[56] References Cited

U.S. PATENT DOCUMENTS

| | | | |
|---|---|---|---|
| 260,077 | 6/1882 | Archdeacon | 220/231 |
| 756,338 | 4/1904 | Doten | 217/62 |
| 1,209,027 | 12/1915 | Quade | 217/62 |
| 1,223,374 | 4/1917 | Dyckman | 220/327 |
| 1,243,974 | 10/1917 | Powers | 220/327 |
| 1,325,349 | 12/1919 | Burgess | 217/62 |
| 1,456,582 | 5/1923 | Wood | 217/62 |
| 2,187,762 | 1/1940 | Uhlrig | 220/231 |
| 2,605,892 | 8/1952 | Waber | 220/345 |
| 2,609,956 | 9/1952 | Stevenson | 217/52 |
| 2,862,640 | 12/1958 | Somavia | 217/12 R |
| 3,079,039 | 2/1963 | Poris | 206/509 |
| 3,084,830 | 4/1963 | Koelsch | 206/509 |
| 3,169,682 | 2/1965 | Hollingsworth | 206/404 |
| 3,182,856 | 5/1965 | Goltz | 217/62 |
| 3,297,153 | 1/1967 | Fattori | 206/403 |
| 3,410,441 | 11/1968 | Phyne | 220/4 F |
| 3,436,081 | 4/1969 | Ungar | 220/345 |
| 3,473,690 | 10/1969 | Cazenove | 220/22 |
| 3,773,213 | 11/1973 | Fredrick | 206/507 |
| 4,230,233 | 10/1980 | Orr | 217/52 |

FOREIGN PATENT DOCUMENTS

| | | | |
|---|---|---|---|
| 2285251 | 9/1974 | France | 206/508 |
| 611899 | 10/1960 | Italy | 220/4 F |
| 47810 | 10/1978 | Japan | 220/94 A |
| 872548 | 7/1961 | United Kingdom | 220/94 A |

*Primary Examiner*—George E. Lowrance
*Attorney, Agent, or Firm*—Eric P. Schellin

[57] ABSTRACT

A container for produce, fruit, groceries, dairy products, and the like comprising a hollow container of substantially rectangular shape, the container including laterally spaced normally vertical side walls, longitudinally spaced normally vertical end walls connecting the side walls at the respective opposite ends of said container and a bottom wall closing the normally lower end of the container. Means defining a guide channel for a slidable cover member on the upper end of said container is provided. The cover member being slidably positioned in the guide channel. The container is open at the upper end of one of the normally vertical walls to permit movement of the slidable cover into or out of the guide channel. A ventilating passage means is provided in at least one of the normally vertical walls. Aperture means is provided in at least one of the normally vertical walls to define a hand-hold for the container; and means forming part of the bottom wall of the container is provided which adapts the container to be stacked in nested superposed relation to the top of another similar container.

3 Claims, 11 Drawing Figures

CONTAINER FOR PRODUCE, FRUITS GROCERIES AND THE LIKE

RELATED APPLICATIONS

This application is a continuation-in-part of my application Ser. No. 305,737; filed Sept. 25, 1981, now abandoned.

FIELD OF THE INVENTION

The present invention relates to a container for transporting or storing fruits, produce, groceries, dairy products or the like which is preferably made of a thermoplastic material but may also be made of wood or other suitable material.

DESCRIPTION OF THE PRIOR ART

While the prior art shows many various types of containers, some of which include various individual features of the construction of the present invention, to the best of my knowledge, no prior patent shows in combination all of the various features of the container of the present invention.

The following patents are representative of the prior art for various individual features of the construction of the present invention (all of the patents listed are U.S. patents except British patent No. 4,159—Baker):

*Sliding top:* Wheat—U.S. Pat. No. 404,880; Brenner—U. S. Pat. No. 2,532,083; Bergh, et al—U.S. Pat. No. 3,531,012; *Vents:* Walker—U.S. Pat. No. 2,098,639; Hoblick—U.S. Pat. No. 2,500,412; Royce—U.S. Pat. No. 2,957,597; Casenove U.S. Pat. No. 3,473,690; Smith—U.S. Pat. No. 4,251,006; *Stacking means:* Casenove—U.S. Pat. No. 3,473,690; Barnes—U.S. Pat. No. 3,506,154; *Bottom Cushion:* Hoblick—U.S. Pat. No. 2,500,412; Stevenson—U.S. Pat. No. 2,609,956; Liebeskind—U.S. Pat. No. 2,979,246; Hardigg—U.S. Pat. No. 3,003,622; Goldman—U.S. Pat. No. 3,421,676; *Handles:* Barnes—U.S. Pat. No. BR 4,159; Fieri—U.S. Pat. No. 3,945,478; Peterson et al—U.S. Pat. No. 3 905,478; Orr—U.S. Pat. No. 4,230,233; Smith—U.S. Pat. No. 4,251,006.

The following U.S. patents are of miscellaneous interest in connection with the disclosure of the present invention: Wilmot—U.S. Pat. No. 2,835,432; Barrez—U.S. Pat. No. 3,077,294; Stollberg et al. —U.S. Pat. No. 4,184,625.

STATEMENT OF THE INVENTION

Accordingly, it is an object of the present invention to provide a container preferably made of a thermoplastic material but which can also be made of wood or other suitable material and which is adapted to be reused a great number of times for shipping or storing items such as fruits, produce, dairy products, groceries, or the like for repetitive uses in contrast to containers of cardboard or the like which generally are suitable only a single use and then must be discarded. The container may be made of clear plastic material to enable the consumer to see the contents on the inside of the container. The plastic material of which the container is made may be made in various solid colors.

It is still another object of the invention to provide a container particularly suitable for transporting fruits, produce, or the like and which is provided with ventilating passages or openings which provide efficient ventilation of the produce or fruits carried by the container.

It is still a further object of the invention to provide a container, preferably made of a thermoplastic material, but which may also be made of other suitable material and which provided hand-holds formed as apertures in the end walls of the container which aid in picking up the container in various positions and which additionally serve as ventilating openings for the container.

It is a further object of the invention to provide a container for transporting and/or storing produce, fruits, groceries, or the like and which includes a slidable cover member and a latching arrangement built into the container structure to retain the slidable cover member in closed position.

It is a further object of the invention to provide a container for transporting and/or storing produce, fruits, groceries, or the like and which includes a cover held with bolts which can be tightened by hand.

It is a further object to the invention to provide a container which can be easily disassembled without resorting to the use of tools for purposes of storage while not in use.

SUMMARY OF THE INVENTION

In achievement of these objectives, there is provided in accordance with the invention a container for transporting or storing fruits, produce, groceries, dairy products, or the like, which is preferably made of a thermoplastic material, but which also may be made of wood, plywood, or other suitable material. The container may be made of clear plastic material to enable the consumer to see the contents on the inside of the container. The plastic material of which the container is made may also be made in various solid colors. The container is of hollow rectangular construction, and includes a cover member which is slidably received in a channel formed in the upper end of the container. A latching arrangement is built into a wall of the container and is engageable with the slidable cover to retain the cover in closed position against unintended opening. The container is provided with ventilating openings in various wall surfaces thereof; and the slidable cover may be provided with ventilating openings or passages. Hand-hold openings are provided at suitable locations on the container, such as the end walls of the container, to facilitate gripping of the container by the user. The hand-hold openings also serve as ventilating openings. A liner of a suitable material such as a plastic material such as styrofoam, or a rubber sponge material or the like, is preferably positioned on the inside of the bottom of the container to serve as a cushioning device for the fruits, produce or other material positioned in the container.

In another embodiment the lid may be fastened to the container from about using bolts having wing-nut type heads for hand tightening.

Another embodiment uses interlocking tongues and grooves to hold the container sides and ends to each other and to the bottom. Such an arrangement permits assembling and disassembling the container without tools.

These and further constructional and operational characteristics of the invention will be evident from the detailed description given hereinafter with reference to the figures of the accompanying drawings which illustrate preferred embodiments and alternatives by way of non-limiting examples.

DESCRIPTION OF THE PREFERRED EMBODIMENT

Figure 1:
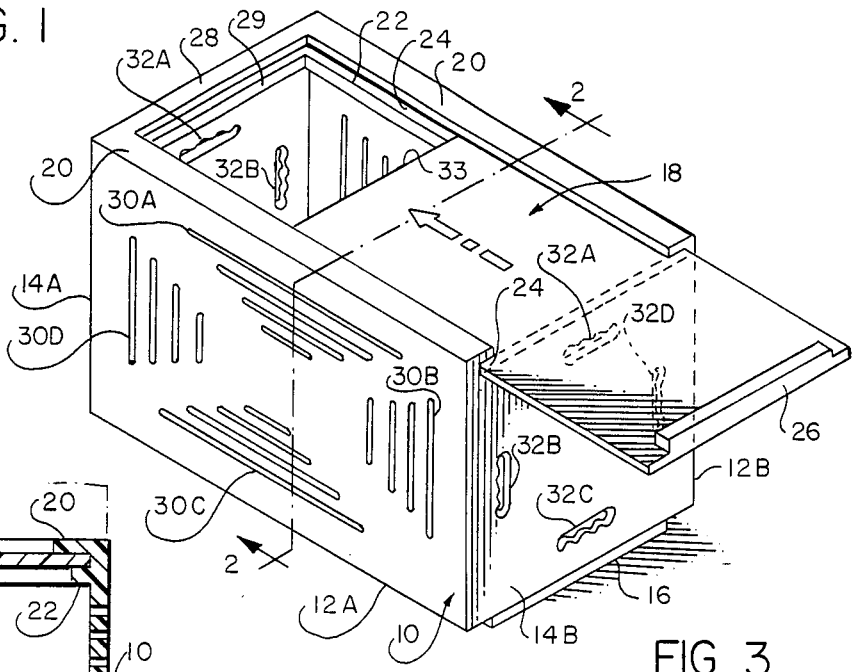
FIG. 1 is a perspective view of the container in accordance with the invention.

Referring now to the drawings, the embodiment of the container of the invention shown in FIGS. 1–5, inclusive, it generally indicated at 10, and is formed of a suitable thermoplastic material, although container 10 can also be formed of other suitable material, such as wood, plywood, or the like. Container 10 may be made of clear plastic material to permit the consumer to see the contents on the inside of the container. The plastic material of which the container is made may also be of various solid colors.

Container 10 is of generally rectangular configuration an includes a pair of opposite longitudinally extending side walls each respectively indicated at 12A and 12B, a pair of opposite end walls respectively indicated at 14A and 14B, and a bottom wall indicated at 16. Container 10 is open at its upper end but is closable by means of a sliding cover or panel generally indicated at 18.

The upper ends of the two longitudinally extending side walls 12 are provided along substantially their entire length with laterally inwardly turned flanges 20 which, together with a laterally inwardly extending lip or ledge 22 which lies below the inwardly turned flange 20 defines a pair of oppositely disposed channels 24 through which cover 18 may be slidably moved from a fully open position in which cover 18 is disengaged from container 10 to a fully closed position in which cover 18 is completely closed.

Cover member 18 is provided with an upstanding handle portion 26 at the right-hand end thereof relative to the view shown in FIG. 1 to permit manual movement of cover 18 along channel members 24. Handle portion 26 projects above the upper surface of cover 18 by a distance such that the upper surface of handle 26 is substantially flush with the upper surface of the oppositely disposed longitudinally extending flanges 20.

The right-hand end of handle 26 is flush with the right-hand edge cover 18, and the lateral width of handle 26 is less than the lateral spacing between the laterally inner ends of the oppositely disposed laterally inwardly turned flanges 20 which define channels 24, whereby to permit handle 26 to clear flanges 20 during the sliding movement of cover 18.

The upper end of the end wall 14A is provided with a laterally inwardly projecting flange 28 which is spaced above and overhangs an inwardly projecting lip or ledge 29 which supports the inner end 32 of slidable cover 18 when cover 18 is in fully closed position. The upper surface of flange 28 of end wall 14A is at the same height as the upper surface of longitudinal flanges 20.

The end wall 14B is open at its upper end to permit slidable cover member 18 to be received in the oppositely-disposed channels 24, with cover 18 being freely movable into or out of the channels 24 at end wall 14B of the container. The latch arrangement, to be described hereinafter, may be used to retain cover 18 against unintended opening movement when in the fully closed position.

Each of the opposite longitudinally-extending walls 12A and 12B is provided with a plurality of ventilating slots or passages therein. In the illustrated embodiment, and, as seen in view of FIG. 1, the ventilating slots in each side wall 12A, 12B are arranged in four groups spaced at 90° with respect to each other, as indicated at 30A, 30B, 30C, and 30D. Each of the groups 30A, 30B, 30C, and 30D includes a plurality of linerly extending slots of progressively decreasing length, with the longer slots of each of the groups 30A, 30B, 30C, and 30D being positioned closer to the outer bounding edge or perimeter of the respective side walls 12A, 12B and with the shorter slots of each of the groups of slots being positioned closer to the center of the respective longitudinal slide walls.

Each of the respective end walls, 14A, 14B is provided with a plurality of hand-hold openings respectively indicated at 32A, 32B, 32C, and 32D, the respective hand-hold openings being arranged at 90° with respect to each other to permit the user of the container to grasp or grip the container when the container is sitting on either side or on its top or bottom. All of the respective hand-hold openings 32A, 32B, 32C, and 32D may be provided with finger-grip contours as indicated at 34A. Each of the hand-hold openings 32A, 32B, etc., also serves as a ventilating opening for the container.

A liner 35 of suitable material such as a plastic material such as styrofoam, or a rubber sponge material or the like, is preferably positioned on the inside of the bottom of the container 10 to serve as a cushioning device for the fruit, produce, or other material positioned in container 10.

Figure 2:
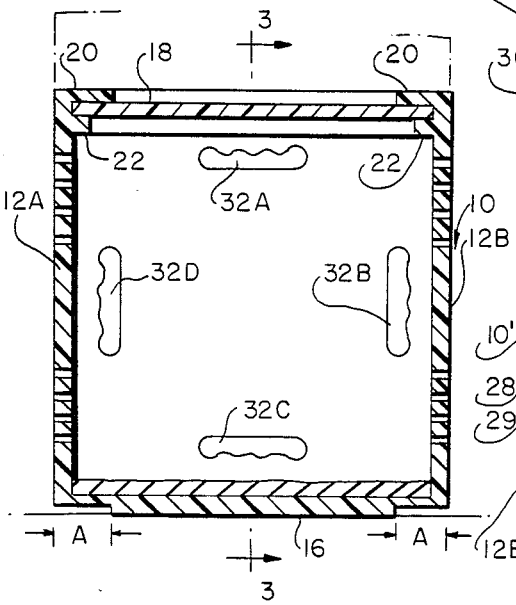
FIG. 2 is a view in transverse section along line 2—2 of FIG. 1.

In the embodiment of the container shown in FIGS. 1–5, inclusive, of the drawings and which is formed of thermoplastic material, the bottom wall 16 is recessed laterally inwardly on two sides thereof by a distance "A" as best seen in the transverse view of FIG. 2. Bottom wall 16 is also recessed inwardly in a longitudinal direction by a distance "B" as best seen in the longitudinal sectional view of FIG. 3. The recessed construction just described permits a plurality of containers 10, such as those indicated at 10 and 10' of FIG. 3 to be stacked in vertically superposed relation. The lateral and longitudinal dimensions of bottom wall 16 of container 10 provided by the lateral and longitudinal recess just described permit bottom wall 16 of the upper superposed container 10' in FIG. 3 to lie within the inner bounding perimeter defined by the oppositely disposed longitudinal flanges 20 of the lower container 10, with the bottom surfaces of the longitudinal side walls 12A and 12B of upper container 10' resting on the upper surfaces of longitudinal flanges 20 of lower container 10.

Figure 3:
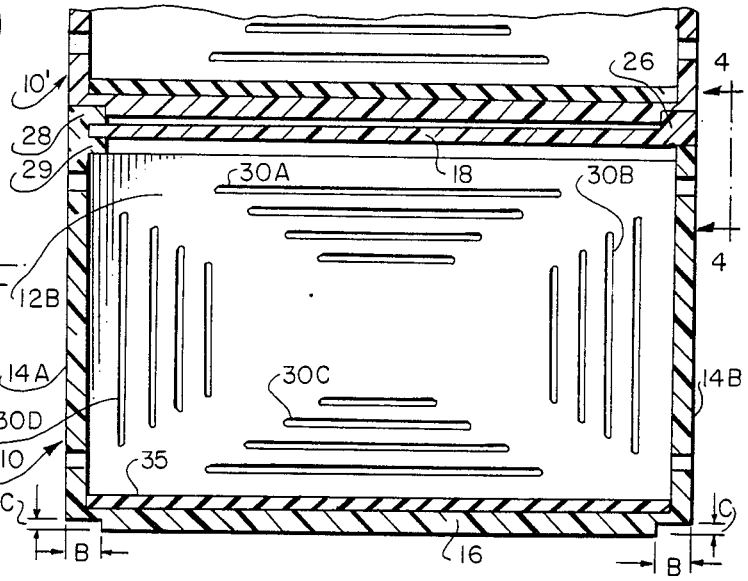
FIG. 3 is a view in longitudinal section of the container taken along section line 3—3 of FIG. 2 and showing a fragmentary view of a second container in superposed stacked relation above the first container.
Figure 4:
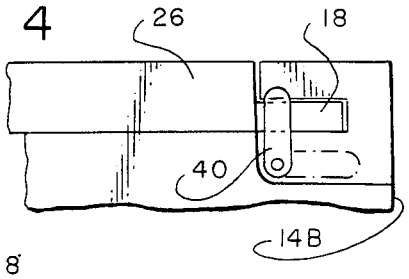
FIG. 4 is a fragmentary view of an end of the container taken along section line 4—4 of FIG. 3, showing details of the latching arrangement for preventing unintended opening movement of the slidable cover member.

Also, the longitudinal recesses of bottom wall 16 indicated at "B" of upper container in FIG. 4 permits bottom wall 16 of upper container 10' to lie within the inner bounding perimeter defined by flange 28 at one end of the lower container 10 and by cover handle 26 of lower container 10 (in the closed position of cover 18). With bottom wall 16 of upper container 10' seated within the bounding perimeter of lower container 10 as just described, the bottom surfaces of the opposite end walls 14A and 14B of upper container 10' in FIG. 3 can then respectively rest on the upper surfaces of flange 28 and of handle 26 (in the closed position of cover 18) respectively.

The vertical height of bottom wall 16, as indicated by "C" in FIG. 3, is such as to permit the bottom surfaces of longitudinal walls 12A, 12B of upper container 10' to rest on the upper surface of longitudinal flanges 20 of lower container 10, and to permit the bottom surfaces of end walls 14A, 14B of upper container 10' to rest on the upper surface of flange 28 and on the upper surface of handle 26 of lower container 10, as just described, with container 10' and 10 in stacked relation as shown in the view of FIG. 3.

Figure 5:
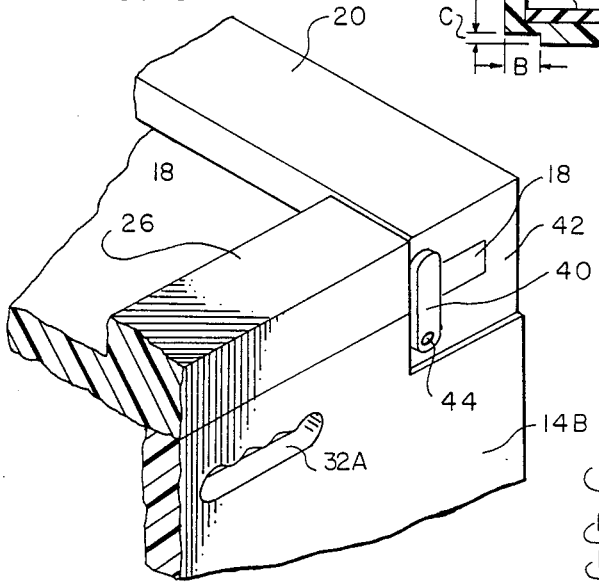
FIG. 5 is a perspective view of the right-hand end of the container, showing the latching arrangement of FIG. 4.
Figure 6:
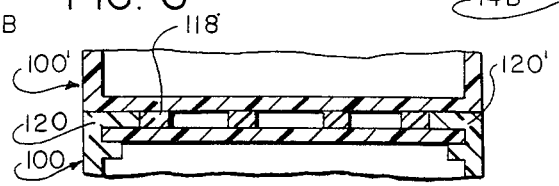
FIG. 6 is a fragmentary view in vertical section showing the bottom portion of a modified container construction made of wood, plywood, or the like in nested stacked relation to the top portion of a similar container.

As shown in the modified embodiment of FIG. 6 which shows a fragementary view of a pair of vertically superposed containers 100' and 100 made of wood, plywood, or the like, the under surface of the bottom wall 116 of each container is provided with a plurality of longitudinally extending laterally spaced batten strips 118 of wood, plywood, or the like, which serve to elevate the bottom surface of bottom wall 116 of the container above the surface upon which container 100 is resting, and which permits stacking of a plurality of containers, such as the containers 100' and 100 of FIG. 6 in stacked nested relation. The lateral distance spanned by the plurality of batten strips 118 and the length of the batten strips 118 in a direction lengthwise of container 100 are such that superposed containers such as 100' and 100 seen in FIG. 6 can be stacked in nested relation as seen in the view of FIG. 6, in a manner similar to that shown and described in connection with the thermoplastic container of FIGS. 1–5, inclusive.

A further feature of the construction and which may be used with either the embodiment of FIGS. 1–5, inclusive, and also with the embodiment of FIG. 6, is the provision of a latch member 400 which is mounted in a recessed region 42 of end wall 14B to prevent unintentional withdrawal of slidable cover member 18 from channels 24. The recessed region 42 is located at the upper portion of one lateral side of end wall 14B. Latch 40 is pivotally mounted at a point 44 in recessed region 42 which lies below the level of the channel 24 on the same lateral side of end wall 14B as the location of recessed region 42.

When slidable cover 18 is in its fully closed position as seen in FIGS. 4 and 5, and it is desired to actuate latch 40 to prevent unintended opening movement of cover 18, latch member 40 is swung upwardly about its pivotal connection 44 to the vertical position shown in full line in FIGS. 4 and 5. With latch 40 in the vertical position shown in full line in FIGS. 4 and 5. With latch 40 in the vertical position shown in full line in FIGS. 4 and 5, latch 40 overlies the end of cover 18 at the end of channel 24 and prevents unintended opening movement of cover 18.

If it is desired to open cover 18, latch 40 is moved about its pivotal support 44 to the horizontal position shown in dotted line in the view of FIG. 4, permitting cover 18 to be slidable moved to open position, or to be removed entirely from its engagement with the main body of container 10.

Figure 8:
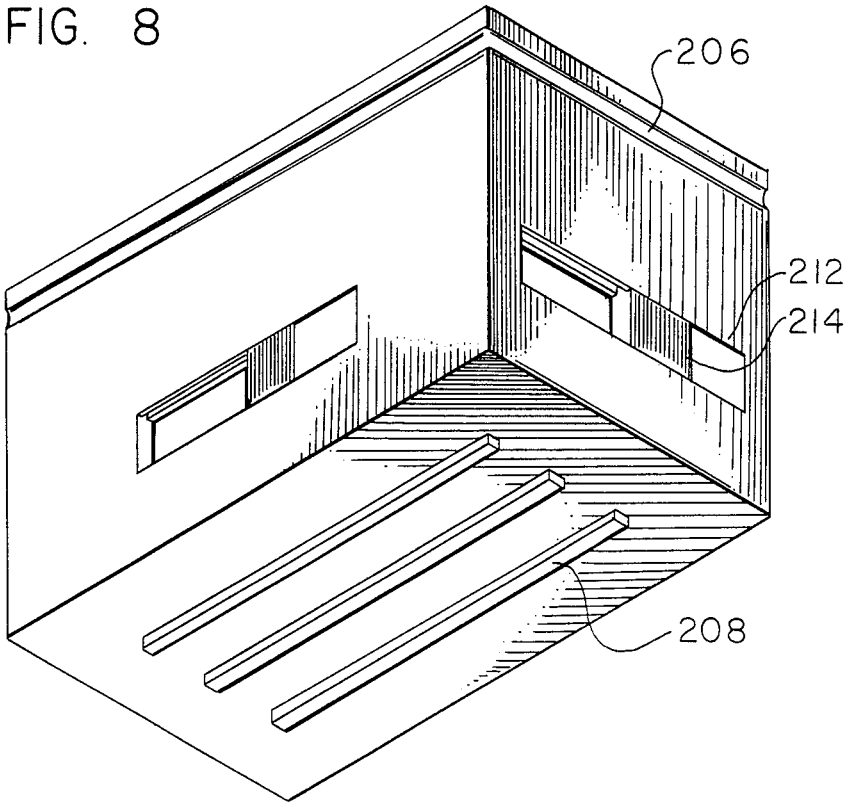
FIG. 8 is a side view of a container having grooves for finger grips.
Figure 7:
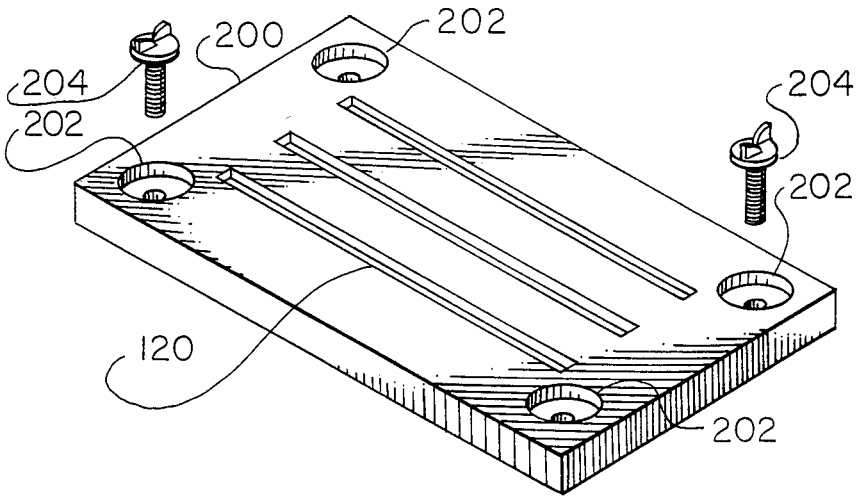
FIG. 7 is a top view of a lid which attaches to the container with bolts having wing-nut shaped heads.

In an alternative embodiment shown in FIGS. 7 and 8, a lid 200 shown from above in FIG. 7 has circular wells 202 with holes 204 through the centers of the wells for the use of bolts having wing-nut type heads. The wells allow recessing the heads of the bolts so that the bolt head will not snag another container. The use of wing-nut type bolts allows tightening without the use of tools.

The container shown in FIG. 8 has a groove 206 running around the sides and ends of the container near the top to facilitate gripping the container with finger tips. Rails 208 on the bottom of the container prevent slipping. Grooves 120 on the lid 200 are slightly larger than the rails 208 to allow stacking the containers. Vent openings 212 on the sides and ends having sliding closures 214. The container is best made of transparent thermoplastic.

Figure 9:
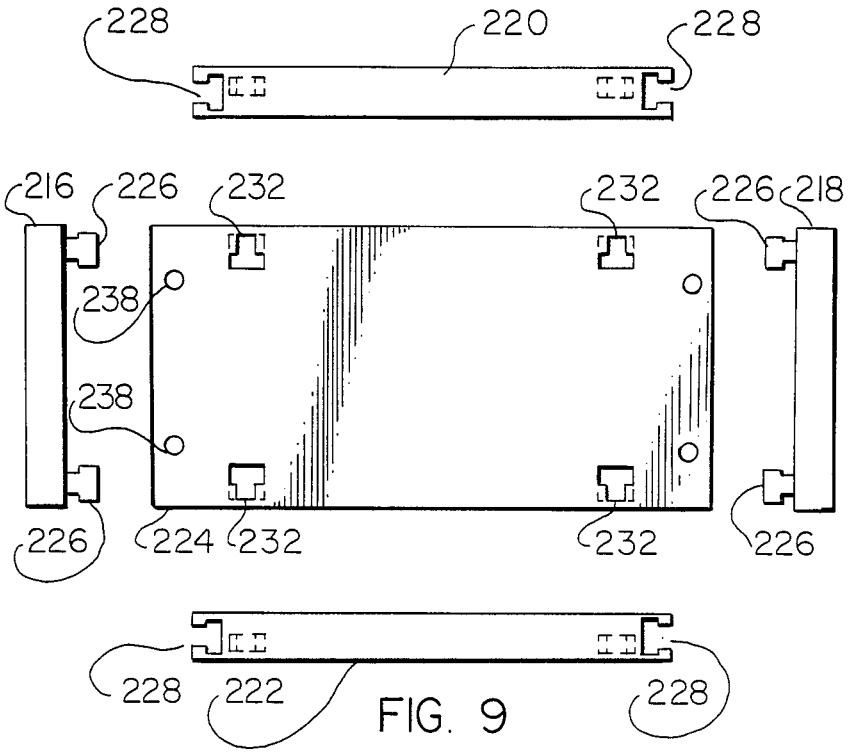
FIG. 9 is an exploded view shown from the top of a container which is disassembled without the use of tools.
Figure 10:
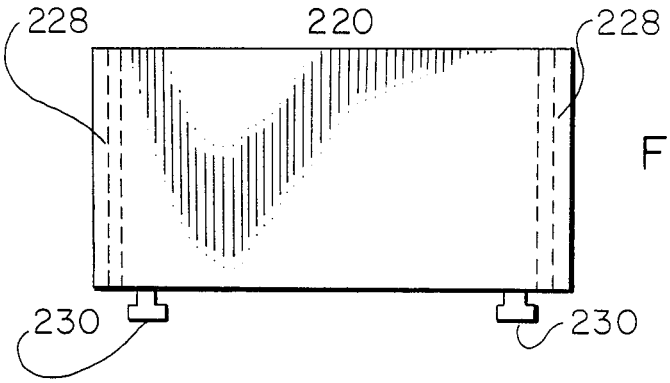
FIG. 10 is a side view of the side of the container shown in FIG. 9.
Figure 11:
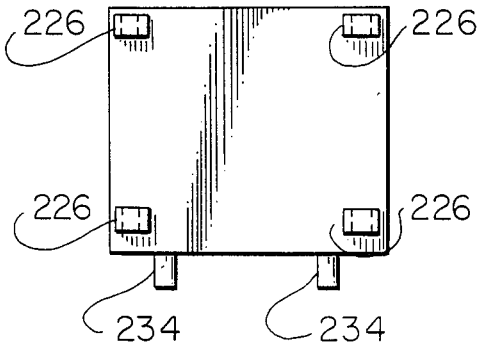
FIG. 11 is a side view of the end of the container shown in FIG. 10.

In a further embodiment shown in FIGS. 9, 10 and 11, a container is shown which can be disassemblied for storage without the use of tools. FIG. 9 shows an exploded view shown from the top showing ends 216 and 218, sides 220 and 222, and bottom 224. The ends have inwardly projected T-shaped tongues 226 which fit into T-shaped grooves 228 in the sides. The sides have downwardly projecting T-shaped tongues 230 which fit into T-shaped apertures 232 in the bottom 224. The ends have downwardly projecting cylindrical pegs 234 formed at their bottoms which fit into cylindrical holes 238 in the bottom 224.

To assemble the container the bottom 224 is placed on a flat surface. The sides 220 and 222 are placed on the bottom 224 with the tongues 230 inserted into the apertures 232. Then the sides 220 and 222 are pushed apart locking the stem of the T-shaped tongues 230 into the stem of the receiving T-shaped apertures 232. The ends 216 and 217 are then slid from the top so that the tongues 226 slide inside the grooves 228 until downwardly projecting pegs 234 are inserted into the receiving holes 238. A lid such as shown in FIG. 7 may then be bolted into the sides 220 and 222 and thereby hold the container together. The container is best made of transparent thermoplastic.

These last two alternative embodiments may contain compatible attributes of the preferred embodiment such as a liner member.

This invention is not limited to the preferred embodiments and alternative heretofore described, to which variations and improvements may be made, consisting of mechanically equivalent modifications to component parts and procedures without leaving the scope of the present patent, the characteristics of which are summarized in the following claims.

What is claimed is:

1. A container for produce, fruit, groceries, dairy products, and the like comprising:

a hollow container of substantially rectangular shape, said container including laterally spaced normally vertical side walls and laterally spaced normally vertical end walls connecting the side walls at the respective opposite ends of the container, the container further including a bottom wall closing the lower end of the container, the end walls having inwardly projecting T-shaped tongues which are adapted to be slided into and engaged by T-shaped receiving grooves in the side walls, the ends walls are also provided with downwardly projecting pegs that engage receiving apertures in the bottom wall of the container, the side walls are provided with downwardly projecting T-shaped tongues which are adapted to be inserted into T-shaped apertures in the bottom wall and are locked in place by pushing the side walls outwardly when the T-shaped tongues are inserted into the bottom wall;

a lid fastened to the container by bolts having heads, said lid having wells to allow for the recessing of the bolt heads and also having a plurality of grooves on top of the lid;

a plurality of rails formed on the bottom wall of said container adapted to fit into the grooves on the lid of an identical container to facilitate stacking;

ventilating passage means formed in at least one of the walls of said container; and a liner member positioned on the inside of said container on the bottom wall to serve as a cushioning device for material positioned in said container.

2. A container as defined by claim 1 wherein the lid and the hollow container are made of transparent thermoplastic.

3. A container as defined by claim 1 wherein the bolts have wing-nut type heads.

* * * * *